US009032974B2

(12) United States Patent
Lee et al.

(10) Patent No.: US 9,032,974 B2
(45) Date of Patent: May 19, 2015

(54) ROTARY POWDER CONTAINER WITH BRUSH

(76) Inventors: Young Joo Lee, Anyang-si (KR); Jae Kwang Hwang, Seoul (KR)

( * ) Notice: Subject to any disclaimer, the term of this patent is extended or adjusted under 35 U.S.C. 154(b) by 0 days.

(21) Appl. No.: 14/111,942

(22) PCT Filed: Apr. 6, 2012

(86) PCT No.: PCT/KR2012/002636

§ 371 (c)(1),
(2), (4) Date: Oct. 15, 2013

(87) PCT Pub. No.: WO2012/141457

PCT Pub. Date: Oct. 18, 2012

(65) Prior Publication Data

US 2014/0251369 A1 Sep. 11, 2014

(30) Foreign Application Priority Data

Apr. 15, 2011 (KR) ..... 10-2011-0035045

(51) Int. Cl.
*A45D 33/02* (2006.01)
*A45D 33/22* (2006.01)
(Continued)

(52) U.S. Cl.
CPC ..... *A45D 33/02* (2013.01); *A45D 33/16* (2013.01); *A45D 33/18* (2013.01); *A45D 33/36* (2013.01); *A46B 7/023* (2013.01); *A46B 9/021* (2013.01); *A46B 11/0013* (2013.01)

(58) Field of Classification Search
CPC ..... A45D 33/003; A45D 33/02; A45D 33/16; A45D 33/26; A45D 33/006; A45D 33/025; A45D 33/22; A45D 33/24; A45D 33/08; A45D 33/18; A45D 33/34; A45D 33/36; A45D 33/20; A45D 2040/225; A45D 2040/227; A45D 2040/228; A46B 11/0013; A46B 7/023; A46B 9/021; B65D 43/14; B65D 43/18
USPC ..... 132/299, 286, 293, 295, 297, 298, 305, 132/313, 315, 317, 318, 290, 333, 314; 220/253; 215/313; 206/581, 823, 235; 222/142.9, 548, 478, 549, 550, 556, 222/557, 565; 401/118, 263, 270; D9/426, D9/428; D28/5, 6, 8, 76–79, 82, 91
See application file for complete search history.

(56) References Cited

U.S. PATENT DOCUMENTS 1,687,451 A * 10/1928 Hoellrigl ..... 132/297
1,714,368 A * 5/1929 Hobson ..... 222/553
(Continued)

FOREIGN PATENT DOCUMENTS

GB 1046635 * 10/1966
JP 2002-291527 A 10/2002
(Continued)

OTHER PUBLICATIONS http://www.lipglossiping.com/2014/03/bareminerals-limited-edition-15th-anniversary-mineral-veil-finishing-powder/.*

*Primary Examiner* — Vanitha Elgart
(74) *Attorney, Agent, or Firm* — Novick, Kim & Lee, PLLC; Jae Youn Kim

(57) ABSTRACT

The present invention relates to a rotary powder container with a brush, wherein powder is discharged through a brush of a powder discharge case by rotating an internal case containing powder in an external case. The internal case is able to be rotated in the external case, wherein powder is discharged into a brush when a plurality of discharge holes of a powder discharge case are in line with a plurality of discharge member holes of a powder discharge member if the internal case is rotated in the external case, and powder is not discharged into a brush when the plurality of discharge holes of the powder discharge case are not in line with the plurality of discharge member holes of the powder discharge member if the internal case is rotated in the external case. The present invention is convenient to use and has an elegant look.

7 Claims, 5 Drawing Sheets

(51) Int. Cl.

| | |
|---|---|
| ***A46B 15/00*** | (2006.01) |
| ***A45D 33/16*** | (2006.01) |
| ***A45D 33/18*** | (2006.01) |
| ***A45D 33/36*** | (2006.01) |
| ***A46B 7/02*** | (2006.01) |
| ***A46B 9/02*** | (2006.01) |
| ***A46B 11/00*** | (2006.01) |

(56) References Cited

U.S. PATENT DOCUMENTS

| | | | | | |
|---|---|---|---|---|---|
| 2,404,485 | A | * | 7/1946 | Gleisner | 229/5.5 |
| 4,626,119 | A | * | 12/1986 | Ladd, Jr. | 401/123 |
| 4,728,211 | A | * | 3/1988 | Ladd, Jr. | 401/123 |
| D337,177 | S | * | 7/1993 | Tiramani et al. | D28/76 |
| 5,326,564 | A | * | 7/1994 | LaRosa et al. | 424/401 |
| D355,727 | S | * | 2/1995 | Bertolini et al. | D28/76 |
| 5,967,374 | A | * | 10/1999 | Baker | 222/142.9 |
| 6,302,301 | B1 | * | 10/2001 | Vette | 222/142.6 |
| 6,457,891 | B1 | * | 10/2002 | Bredacts | 401/123 |
| 6,474,346 | B1 | * | 11/2002 | Jang | 132/307 |
| 6,966,468 | B2 | * | 11/2005 | McKay et al. | 222/486 |
| 7,011,098 | B2 | * | 3/2006 | Byun | 132/293 |
| 8,066,019 | B2 | * | 11/2011 | Zhu et al. | 132/299 |
| 8,839,803 | B2 | * | 9/2014 | Holloway | 132/307 |
| 2007/0209675 | A1 | * | 9/2007 | Byun | 132/299 |

FOREIGN PATENT DOCUMENTS

| | | | |
|---|---|---|---|
| KR | 20-0369800 | Y1 | 12/2004 |
| KR | 10-2005-0016644 | A | 2/2005 |

* cited by examiner

ROTARY POWDER CONTAINER WITH BRUSH

TECHNICAL FIELD

The present invention relates to a rotary powder container with a brush, and more particularly, to a rotary powder container with a brush in which the powder is discharged through a brush of a powder discharging case by rotating an internal case containing the powder within an external case.

BACKGROUND ART

A woman applies usually color make up in order to express herself more elegantly using various cosmetics and powder is one of the cosmetics.

The powder is spread lightly and is daubed comfortably on skin, and further strong water repellence with respect to water. Accordingly, a user feels freshly when applying make up, and a make up state looks natural.

In general, when a woman wishes to put on make up using powder, she coats a puff prepared separately in a body with powder contained in a body of a powder container.

According to a related art, when a woman applies make up or refresh make up using the puff prepared in the body of the powder container, she holds an mirror with one hand and the puff with the other hand, and coats the puff with powder contained in the body of the powder container to put on make up while putting down the body of the powder container containing powder on a floor. Accordingly, it is very difficult to apply make up using powder and further the powder coated on the puff is scattered while moving the puff coated with powder from a floor to a face. Additionally, the body of the powder container is disposed on a floor while applying make up and thus the body of the powder container is fall down when external force is applied unexpectedly thereto and the powder therein is poured out.

PRESENT INVENTION

Technical Problem

The present invention has been made in view of the above drawbacks, and an object of the present invention relates to provide a rotary powder container provided with a brush in which the powder is discharged through the brush of a powder discharging case by rotating an internal case containing the powder within an external case.

Technical Solution

A rotary powder container provided with a brush according to a first embodiment of the present invention includes: hollow semi-circular internal and external cases, which are connected rotatably around central points of the respective curvatures; a powder discharging case a lower surface of which is connected to an upper opening of the internal case and to upper surface of which a brush is connected; and a powder discharging member which is inserted into a lower surface of a middle partition to be connected to the power discharging case through two circular bars in order to open/close a plurality of discharging holes formed in a line through the middle partition of the powder discharging case.

Advantageous Effects

According to a rotary powder container provided with a brush of the present invention, when the internal case is disposed inside the external case while the internal case is rotated within the external case, a plurality of discharging holes of the powder discharging case correspond to a plurality of discharging member-holes of the powder discharging member, and thus the powder is discharged to the brush. On the contrary, when the brush of the internal case is disposed inside the external case while the internal case is rotated within the external case, a plurality of discharging holes of the powder discharging case does not correspond to a plurality of discharging member-holes of the powder discharging member, and thus the powder is not discharged to the brush. Accordingly, the rotary powder container can be used conveniently and looks elegant.

BEST MODE

Mode of the Invention

Hereinafter, exemplary embodiments of the present invention are described with reference to the accompanying drawings in detail.

[Embodiment]

Figure 1:
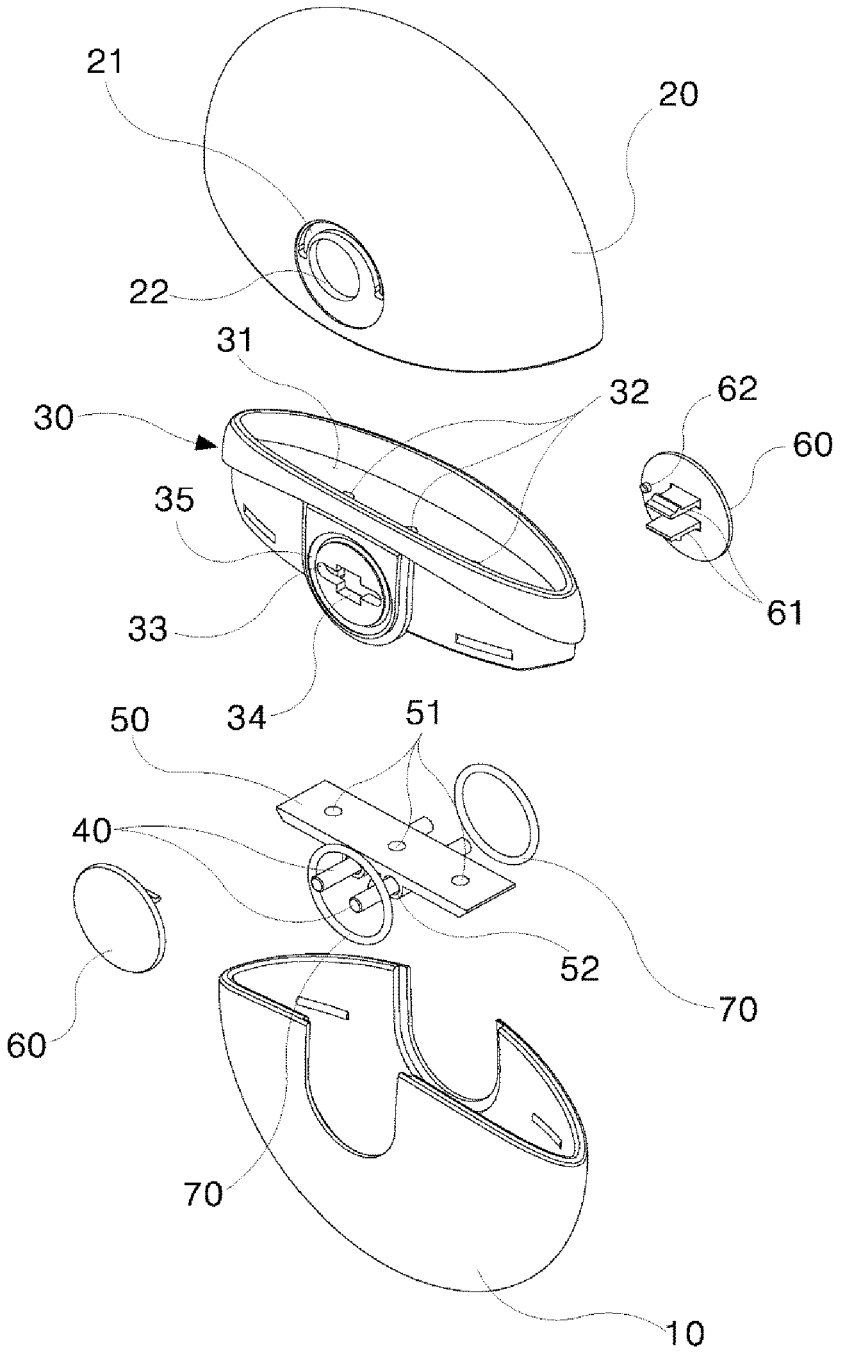
FIG. 1 is an exploded perspective view showing a rotary powder container provided with a brush according to an embodiment of the present invention.
Figure 2:
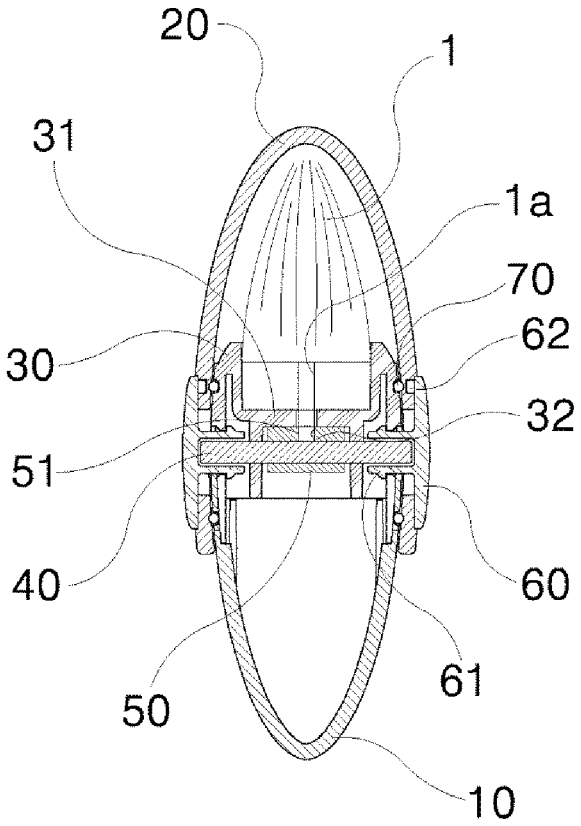
FIG. 2 is a side cross-sectional view showing a rotary powder container provided with a brush according to an embodiment of the present invention.
Figure 3:
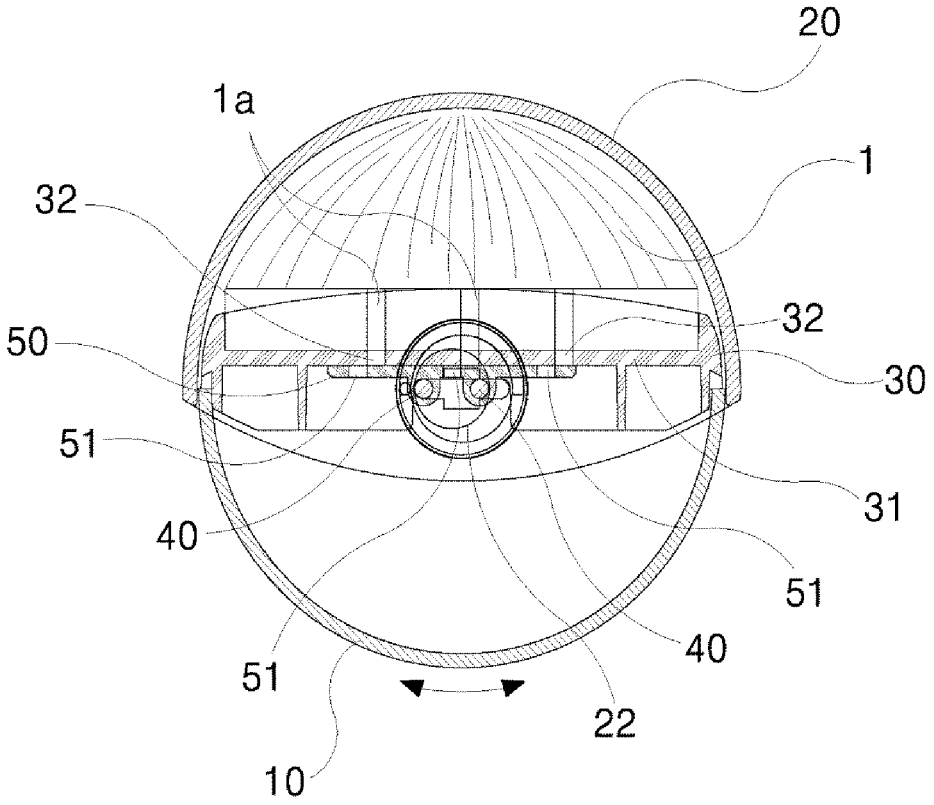
FIG. 3 is a front view showing a rotary powder container provided with a brush when it is not used, according to an embodiment of the present invention.
Figure 4:
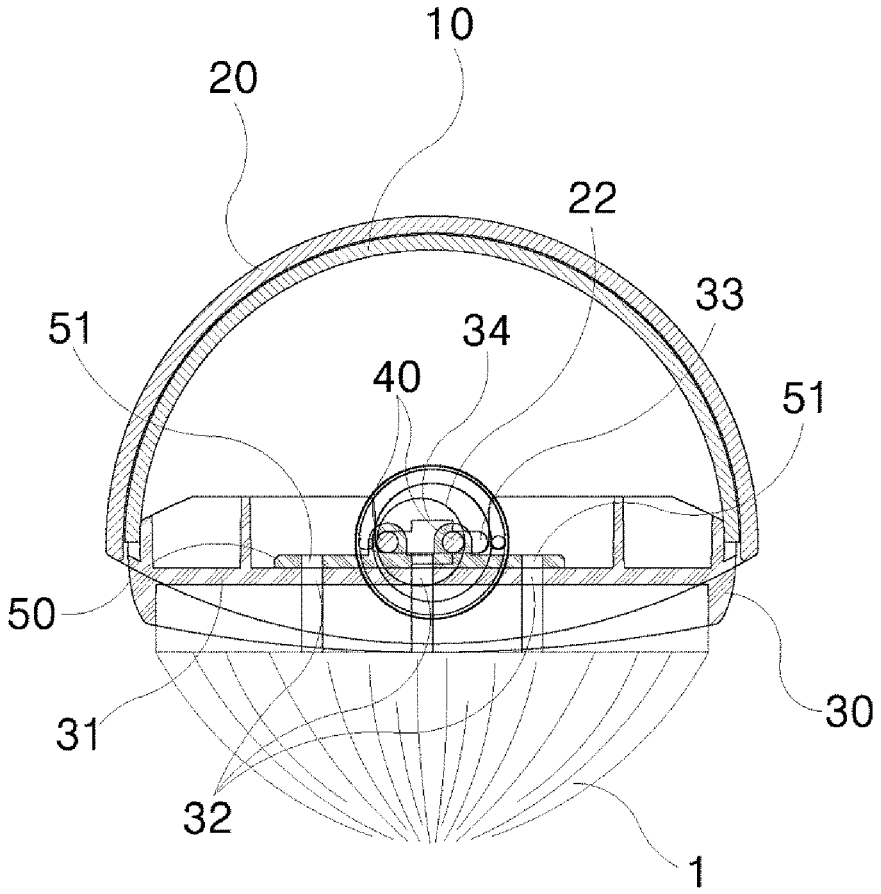
FIG. 4 is a front view showing a rotary powder container provided with a brush when it is used, according to an embodiment of the present invention.
Figure 5:
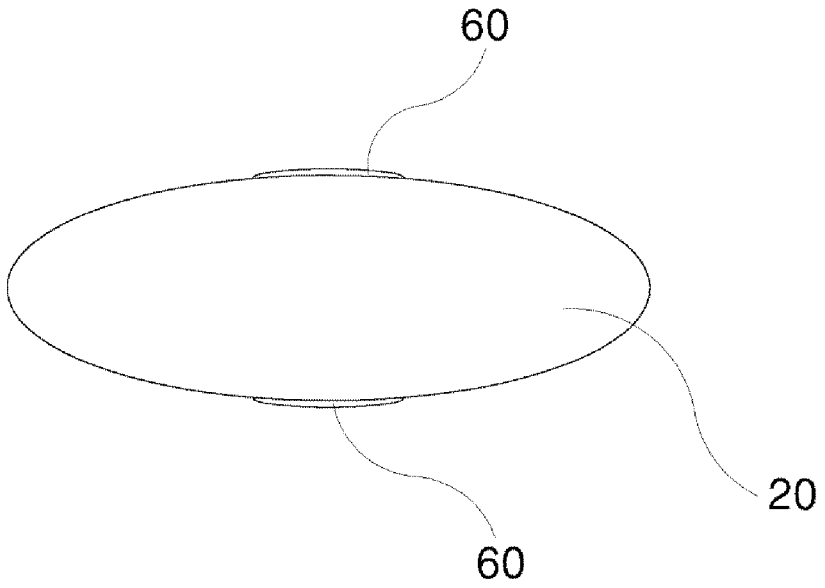
FIG. 5 is a flat view showing a front view showing a rotary powder container provided with a brush according to an embodiment of the present invention.
Figure 6:
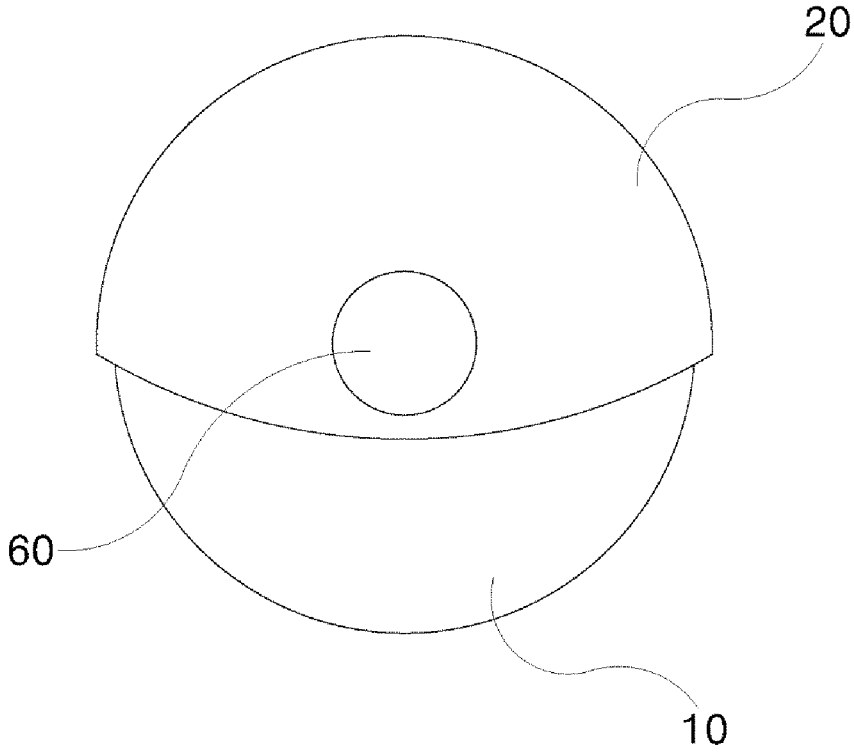
FIG. 6 is a front view showing a rotary powder container provided with a brush according to an embodiment of the present invention.

FIG. 1 is an exploded perspective view showing a rotary powder container provided with a brush according to an embodiment of the present invention, FIG. 2 is a side cross-sectional view showing a rotary powder container provided with a brush according to an embodiment of the present invention, FIG. 3 is a front view showing a rotary powder container provided with a brush when it is not used, according to an embodiment of the present invention, FIG. 4 is a front view showing a rotary powder container provided with a brush when it is used, according to an embodiment of the present invention, FIG. 5 is a flat view showing a front view showing a rotary powder container provided with a brush according to an embodiment of the present invention, and FIG. 6 is a front view showing a rotary powder container provided with a brush according to an embodiment of the present invention.

As shown in FIGS. 1 to 6, a rotary powder container according to an embodiment of the present invention includes: hollow semi-circular internal and external cases 10, 20, which are connected rotatably around central points of the respective curvatures; a powder discharging case 30 a lower surface of which is connected to an upper opening of the internal case 10 and to upper surface of which a brush is connected; and a powder discharging member 50 which is inserted into a lower surface of a middle partition 31 to be connected to the power discharging case 30 through two circular bars 40 in order to open/close a plurality of discharging holes 32 formed in a line through the middle partition 31 of the powder discharging case 30.

Here, a semi-circular band shape hole 21 is formed on a center of an outer peripheral surface of the external case 20, that is, on both sides of a center of curvature, to have same curvature as not-opened outer peripheral surface, and an eccentric circular hole 22 provided eccentrically and horizontally on the basis of the middle partition 31 from a center of curvature of the semi-circular band shape hole 21 is formed.

The powder discharging case 30 is an oval member wherein long holes 33 are formed on both sides in along axial direction and rectangular grooves 34 are formed on a lower and upper surfaces, respectively.

Here, the ends of two circular bars 40 are inserted into the long holes 33, respectively.

Meanwhile, the powder discharging member 50 is a rectangular plate shape member that is in close contact to a lower surface of the middle partition 31 of the powder discharging case 30, and a plurality of discharging member-holes 51 are formed therethrough, which are formed on same line as the plurality of discharging holes 32 of the middle partition 31 and corresponds to the discharging holes 32 when the internal case 10 is inserted into the external case 20. Additionally, insertion holes 52 into which two circular bars 40 are inserted are formed on a lower surface of the powder discharging member 50 in a short axial direction.

The plurality of discharging holes 32 formed through the middle partition 31 are disposed at a location being eccentric opposite to an eccentric direction of the eccentric circular hole 22.

The reference numeral 60 designates a circular cap on inner side of which catching protrusions 61 that are inserted into two lower and upper rectangular grooves 34 of the powder discharging case 30 are formed. A protrusion 62 that is inserted into the semi-circular band shape hole 21 of the external case 20 is formed on one side of the catching protrusion 61.

The reference numeral 70 designates is an O-ring that is inserted between the connection portions of the internal and external cases 10, 20 to maintain air-sealing therebetween wherein the O-ring 70 is inserted to a circular groove 35 formed on a peripheral surface of the long hole 33 of the powder discharging case 30.

Meanwhile, vertical holes 1*a* are formed through a body of the brush 1 to correspond to the plurality of discharging holes 32, respectively, when the brush is inserted into the powder discharging case 30 and thus the powder within the internal case 10 is discharged to the brush 1 when the rotary powder container is used.

Next, operation and effects of the rotary powder container provided with a brush as configured above will be described.

First, when describing assembling procedure, the powder discharging case 30 is seated through the upper opening of the internal case 10 containing powder wherein the powder discharging member 50 is inserted to a lower surface of the middle partition 31 of the powder discharging case 30 and two circular bars 40 are inserted into the long hole 33 of the powder discharging case 30 and the lower insertion hole 52 of the powder discharging member 50. After that, the brush 1 is inserted to an upper surface of the middle partition 31 of the powder discharging case 30 such that the vertical holes 1*a* of the brush are to match with the plurality of discharging holes 32 of the middle partition 31, respectively.

The powder discharging case 30 as assembled in forgoing manner is inserted into the internal case 10 through its upper openings such that the long holes 33 are protruded to both sides of the internal case 10 and the O-ring 70 is fitted to the circular groove 35 formed on an outer peripheral surface of the long hole 33. In a state where the powder discharging case 30 is connected to the internal case 10, the external case 20 is connected to an upper side of the powder discharging case 30 such that the both ends of the circular bars 40 are disposed on an inner peripheral surface of the eccentric circular hole 22 of the external case 20.

After that, the circular cap 60 is fitted to the external case 20 wherein two catching protrusions 61 pass through the eccentric circular hole 22 of the external case 20 and then are fitted to the rectangular r grooves 34 of the powder discharging case 30, respectively, and the protrusion 62 is inserted to the semi-circular band shape hole 21 of the external case 20, thereby completing to assemble the rotary powder container provided with a brush.

INDUSTRIAL APPLICABILITY

In the assembled rotary powder container provided with a brush, as shown in FIG. 4, in a case where the rotary powder container is used, when the internal case 10 is rotated in one direction of left and right directions, the internal case 10 is inserted into the external case 20 and the brush 1 is exposed outside. Here, when the brush 1 is exposed outside as described above, a plurality of discharging holes 32 formed through the middle partition 31 of the powder discharging case 30 correspond to the discharging member-hole 51 of the powder discharging member 50 and thus the powder within the internal case 10 is discharged to the brush 1.

Although embodiments have been described with reference to a number of illustrative embodiments thereof, it should be understood that numerous other modifications and embodiments can be devised by those skilled in the art. Therefore, the real technical protection scope of the present invention needs to be from the technical spirit and equivalent scopes of the appended claims of the present invention.

The invention claimed is:

1. A rotary powder container comprising:

a brush;

hollow semi-circular internal and external cases connected rotatably with each other through a powder discharging case having a lower surface, an upper surface and a middle partition, wherein the lower surface is connected to an upper opening of the internal case and the upper surface is connected with the brush; and a powder discharging member inserted into a lower surface of the middle partition, connected to the power discharging case through two circular bars (40) and configured to open/close a plurality of discharging holes formed in a line through the middle partition of the powder discharging case.

2. The rotary powder container of claim 1, wherein the external case includes a semi-circular band shape hole disposed on both sides of a center of an outer peripheral surface of the external case, and an eccentric circular hole disposed eccentrically from a center of the semi-circular band shape hole.

3. The rotary powder container of claim 2, wherein the powder discharging case is an oval member including two elongated holes disposed horizontally on both sides in an axial direction and into which the two circular bars are inserted, respectively, and wherein each of the two elongated holes includes a lower groove disposed on a lower surface thereof and an upper groove disposed on an upper surface thereof.

4. The rotary powder container of claim 2, wherein the powder discharging member is a rectangular plate shape member that is in close contact to the lower surface of the middle partition of the powder discharging case and includes:

a plurality of discharging member-holes which are disposed in line with the plurality of discharging holes of the middle partition and correspond to the discharging holes when the internal case is inserted into the external case; and insertion holes which are formed on a lower surface of the powder discharging member in an axial direction for the two circular bars to be inserted therein.

5. The rotary powder container of claim 3, further comprising a circular cap configured to be inserted into the semi-circular band shape hole of the external case, wherein the circular cap includes: catching protrusions (61) that are inserted into the two lower and upper grooves of the powder discharging case; and a protrusion which is formed on one side of the catching protrusions to be inserted into the semi-circular band shape hole.

6. The rotary powder container of claim 3, further comprising an O-ring disposed between contact portions of the internal and external cases to maintain air-sealing therebetween, wherein the O-ring is inserted to a circular groove formed on a peripheral surface of each of the elongated holes of the powder discharging case.

7. The rotary powder container of claim 4, wherein vertical holes are formed through a body of the brush that is inserted into the powder discharging case to correspond to the plurality of discharging holes, respectively.

* * * * *